US005231407A

United States Patent [19]

McGirr et al.

[11] Patent Number: 5,231,407

[45] Date of Patent: Jul. 27, 1993

[54] DUPLEXING ANTENNA FOR PORTABLE RADIO TRANSCEIVER

[75] Inventors: Andrew E. McGirr; Paul M. Camwell; John G. McRory, all of Calgary, Canada

[73] Assignee: NovAtel Communications, Ltd., Calgary, Canada

[21] Appl. No.: 725,213

[22] Filed: Jun. 25, 1991

Related U.S. Application Data

[63] Continuation of Ser. No. 339,573, Apr. 18, 1989, abandoned.

[51] Int. Cl.[5] ..... H01Q 1/24; H01Q 1/38; H01Q 1/52

[52] U.S. Cl. ..... 343/700 MS; 343/702; 343/745; 343/841; 455/89; 455/351

[58] Field of Search ..... 343/700 MS File, 702, 343/841, 745, 829, 846; 455/347, 269, 351, 78, 89

[56] References Cited

U.S. PATENT DOCUMENTS

| | | | |
|---|---|---|---|
| 2,573,914 | 11/1951 | Landon | 343/841 |
| 2,947,987 | 8/1960 | Dodington | 343/841 |
| 4,074,270 | 2/1978 | Kaioi | 343/700 MS |
| 4,167,010 | 9/1979 | Kerr | 343/700 MS |
| 4,383,332 | 5/1983 | Glance et al. | 455/33 |
| 4,410,891 | 10/1983 | Schaubert et al. | 343/700 MS |
| 4,460,899 | 7/1984 | Schmidt et al. | 343/841 |
| 4,471,493 | 9/1984 | Schober | 343/702 |
| 4,475,108 | 10/1984 | Moser | 343/700 MS |
| 4,486,722 | 12/1984 | Landt | 333/17 M |
| 4,521,781 | 6/1985 | Campi et al. | 343/700 MS |
| 4,571,595 | 2/1986 | Phillips et al. | 343/702 |
| 4,611,212 | 9/1986 | Lee | 343/844 |
| 4,633,519 | 12/1986 | Gotoh et al. | 455/277 |
| 4,709,239 | 11/1987 | Herrick | 343/700 MS |
| 4,792,809 | 12/1988 | Gilbert et al. | 343/770 |
| 4,800,392 | 1/1989 | Garay et al. | 343/700 MS |
| 4,806,944 | 2/1989 | Jacomb-Hood | 343/745 |
| 4,849,765 | 7/1989 | Marko | 343/702 |

FOREIGN PATENT DOCUMENTS

| | | |
|---|---|---|
| 0177362 | 10/1985 | European Pat. Off. . |
| 2090105 | 11/1980 | United Kingdom . |
| 2178269A | 6/1986 | United Kingdom . |

OTHER PUBLICATIONS

Carver, K. R., Mink, J. W., "Microstrip Antenna Technology", *IEEE Transactions On Antennas and Propagation*, vol. AP-29, No. 1, Jan. 1981.

Kuboyama, K. "UHF Bent-Slot Antenna System for Portable Equipment-I", May 1987, vol. VT-36, pp. 78-85.

Taga T. "Performance Analysis of a Built In Planar (inverted F Antenna for 800 MHz Band Portable Radio Units", Jun. 1987, vol. SAC-5, No. 5.

*Primary Examiner*—Michael C. Wimer

*Attorney, Agent, or Firm*—Cesari and McKenna

[57] ABSTRACT

An antenna for use with portable duplex radio transceivers, such as those found in hand-held cellular telephones, which includes a pair of co-planar radiating patch elements elevated above a conductive surface by a conductive bar. The surface and bar define a reference ground plane which inherently isolates the patches. The patches are shaped so that they operate in a desired frequency band as well as band-pass filters—one of the patches is tuned to the transmit band and serves a transmit structure, and the other patch is tuned to the receive band and serves as a receive structure. Switching devices such as positive-intrinsic negative (PIN) diodes can be disposed along the space between the patches and the ground plane to allow each structure to be tuned. The antenna is efficient, because of inherent isolation between the receive and transmit patches, and eases the front end filtering functions traditionally performed by a duplexer. It can be completely enclosed within the chassis of a hand-held telephone.

20 Claims, 6 Drawing Sheets

DUPLEXING ANTENNA FOR PORTABLE RADIO TRANSCEIVER

This application is a continuation of a prior U.S. Pat. application Ser. No. 07/339,573, filed Apr. 18, 1989.

FIELD OF THE INVENTION

This invention relates generally to antennas, and particularly to an antenna adapted for operation with portable radio transceivers, such as those used in hand-held cellular telephones.

BACKGROUND OF THE INVENTION

Demand for cellular telephone service continues to grow exponentially, with market analysts presently projecting that over ten million cellular telephones will be in operation in North America by 1992. As a result of this demand, it can be expected that the market for cellular subscriber equipment will continue to be quite competitive.

Increasingly, consumers are willing to pay more for a portable, hand-held cellular telephone ("hand-held"). This is primarily because a hand-held telephone is more versatile than a mobile cellular telephone ("mobile") intended for permanent installation in a vehicle.

In order to remain competitive, however, a hand-held must be as physically small and lightweight as possible. Because hand-helds are purchased at a premium customers also expect excellent quality transmission and reception. Accordingly, the electronic radio frequency (RF) components used in a handheld must be extremely efficient, not only in the range of functions provided in a given physical volume, but also in terms of power dissipation, since hand-helds invariably operate on battery power.

While adequate efficiency is easily achieved at low carrier frequencies, such as those in the high-frequency (HF) band traditionally reserved for conventional mobile telephone service, such is not the case for a cellular telephone, which typically uses carrier frequencies in the Very High Frequency (UHF) band, above 800 megahertz (MHz). Current designs provide adequate operation at these frequencies if the RF circuits are fairly narrowband. Since a cellular transceiver must be capable of operating on any one of hundreds of channels upon command from a base station, its required operating bandwidth usually exceeds 25 MHz. This is not considered to be a particularly narrow bandwidth.

Typically the higher the frequency, and the wider the bandwidth of an RF component, the less efficient it is. Reduced RF component efficiency translates directly into an increased demand on the power supply. This efficiency dilemma is particularly troublesome to the designer of a hand-held transceiver, since power consumption must be minimized if the battery is to be as small and lightweight as possible.

Another RF design consideration in a cellular telephone is the duplexer. The duplexer allows the transmitter and receiver to operate simultaneously, and hence allows the user to talk and listen at the same time, as with a conventional telephone. This so-called duplex operation typically requires that the transmitter operate at a different radio frequency than the receiver.

Thus, where there is only one antenna, duplex operation requires the transmitter and receiver to share the antenna. This sharing is accomplished by a duplexer, which is a three-port filter coupled to the antenna, the receiver, and the transmitter. The duplexer prevents transmitter RF signals from damaging or interfering with the receiver. Thus, it provides a low impedance path from the transmitter to the antenna for signals at the transmit frequency, and a high impedance path from the transmitter to the receiver, so that the receiver is isolated from the transmit signals. The duplexer also provides a low impedance path between the antenna and receiver for signals at the receive frequency, and a high impedance path between the receiver and transmitter, so that the transmitter is isolated from the receive signals.

The duplexer presents a problem to the designer of a cellular transceiver because of the required proximity of the transmitter and receiver bands, broad bandwidth, and high isolation. In fact, these requirements cannot usually be met without a multiple pole bandpass filter positioned in the transmit signal path. The need for a filter with multiple poles between the transmitter and the antenna in turn means that a fairly large insertion loss must be accepted. This results in reduced transmitter efficiency, and a corresponding increase in the amount of power which the battery must provide.

Because of these and other design requirements, a duplexer is often the most expensive single component of a hand-held cellular telephone.

Consider another RF component, the antenna itself. Generally speaking, as the operating frequency of an antenna is increased, its sensitivity to perturbation by the surrounding environment is also increased. At present, most hand-held cellular telephones use monopole, or so-called "whip", antennas. However, the gain of a whip antenna is noticeably reduced by the proximity of a human body. This is indeed another perplexing problem to the designer of a hand-held cellular telephone, since the hand-held necessarily must be used in such a fashion as to bring the antenna extremely close to the user's head. The transmitter in such a unit must normally be designed to have sufficient reserve power to overcome the loss presented by the user's head.

Another consideration in the design of an antenna for hand-helds is that RF radiation into the head of the user should be minimized. Such is not always the case with various whip antenna designs.

Whip antennas are also considered to be a nuisance, whether they are of the fixed-geometry or retractable type. Fixed-geometry whip antennas tend to break, and are often in the way when the hand-held must be stored. Retractable whip antennas must be extended to operate the hand-held and then retracted after use.

Some have proposed compact antenna structures for high frequency portable radio operation. See, for example, Taga, et al., "Performance Analysis of a Built-In Planar Inverted F Antenna for 800 Mhz Band Portable Radio Units", *IEEE Journal on Selected Areas in Communication*, Vol. SAC-5, No. 5, Jun. 1987, pp. 921–929, and Kuboyama, et al., "UHF Bent Slot Antena System for Portable Equipment-I", *IEEE Transactions on Vehicular for Technology*, Vol. VT-36, No. 2, May 1987, pp. 78–85.

SUMMARY OF THE INVENTION

It is among the objects of this invention to provide an efficient antenna structure for use with hand-held duplex radio transceivers. Where possible, the antenna should ease, or even eliminate, the front end filtering functions traditionally performed by a duplexer. It should also exhibit none of the undesirable features of whip antennas. The antenna should be simple and inexpensive to fabricate.

In one embodiment, an antenna constructed in accordance with the invention includes a pair of radiating patch elements. The patch elements are elevated above a conductive surface by a conductive pedestal. The surface and pedestal define a reference ground plane such that the two patch elements are inherently electrically isolated.

The patches are shaped so that they resonate in a desired frequency band. In addition, because the two patches are physically independent of one another, they each can be designed as a band-pass filter. Thus, one of the patches is tuned to the transmit band and serves as a transmit structure, and the other patch is tuned to the receive band and serves as a receive structure.

The ground plane can also include a ground patch disposed between and spaced away from the two radiating patches. In this embodiment, switching devices such as positive-intrinsic negative (PIN) diodes are disposed along the space between the ground patch and the transmit patch, as well as along the space between the ground patch and the receive patch. The receive and transmit patches are electrically tuned to a desired operating channel within their respective bands by selectively opening and closing the switches to adjust the impedance of the radiation patches.

There are many advantages to this invention. Because the transmit and receive patches are inherent band-pass structures, significant isolation between the transmitter and receiver is provided. And because of this inherent isolation, the filtering requirements normally associated with duplex radio operation are reduced. In addition, insertion loss is minimized, since at least some rejection of out-of-band frequencies is inherent in the physical structure of the antenna.

A significant cost savings is realized over conventional arrangements that use an antenna and separate duplexer. In addition, because the tunable structure significantly reduces or eliminates the filtering requirements of the duplexer, it can occupy much less space than the conventional antenna and duplexer. The near-field of the antenna is such that direct radiation into the user's head is minimized.

BRIEF DESCRIPTION OF THE DRAWINGS

The above and further advantages of the invention may be better understood by referring to the following description in conjunction with the accompanying drawings, in which.

DETAILED DESCRIPTION OF ILLUSTRATIVE EMBODIMENTS

Figure 1:
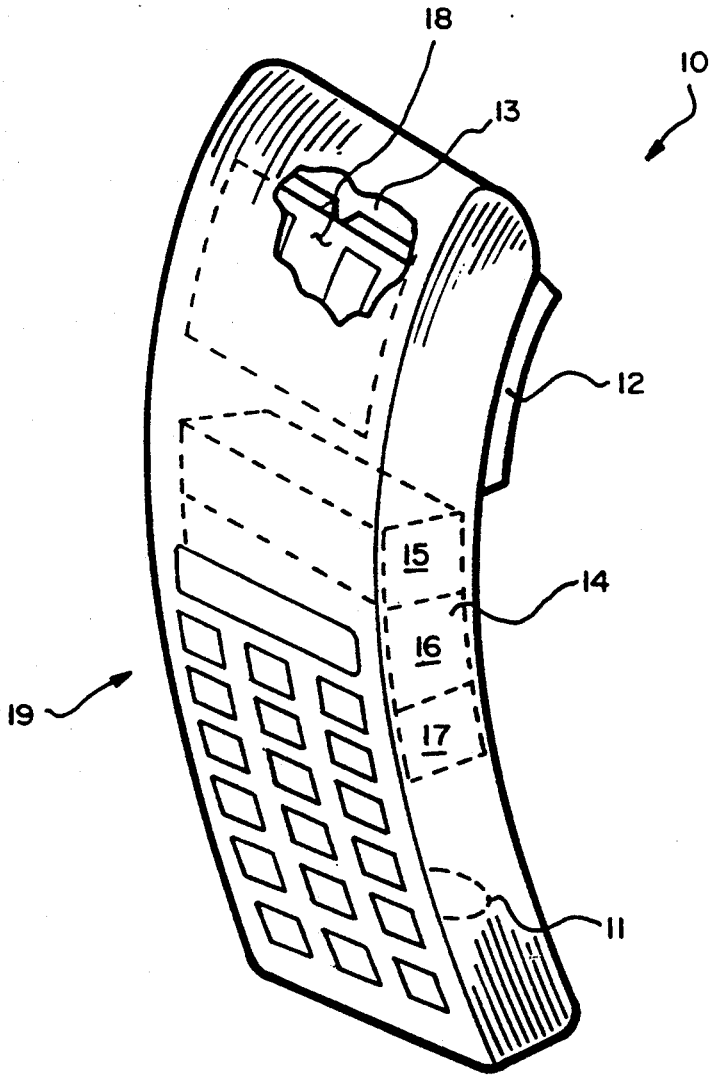
FIG. 1 is a perspective view of a hand-held cellular telephone which makes use of a planar antenna constructed in accordance with this invention.

Turning attention now to FIG. 1, there is shown a hand-held, portable cellular telephone (hand-held) 10. Hand-held 10 includes the elements of a conventional cellular telephone, including a mouthpiece 11, an earpiece 12, a keypad and display 19 and a transceiver 14 which includes a transmitter 15 and receiver 16, all mounted inside an enclosure 13 shaped generally as a telephone handset. The transmitter 15 is modulated by the audio signals received at the mouthpiece 11 to provide radio frequency (RF) transmit signals. Similarly, the receiver 16 demodulates RF receive signals to provide audio signals to the earpiece 12. Other circuits 17 in the transceiver 14 perform standard functions such as reading the keypad and operating the display 19 to obtain a telephone number, initiating a telephone call over the cellular network, issuing instructions to the transmitter 15 and receiver 16 to tune to a particular cellular telephone channel, and so forth.

In accordance with this invention, an antenna 18, also contained in the enclosure 13, is fed the RF transmit signal from the transmitter 15, and provides the RF receive signal to the receiver 16. Note that the antenna 18 does not protrude beyond the enclosure 13 as does a conventional whip antenna.

Figure 2:
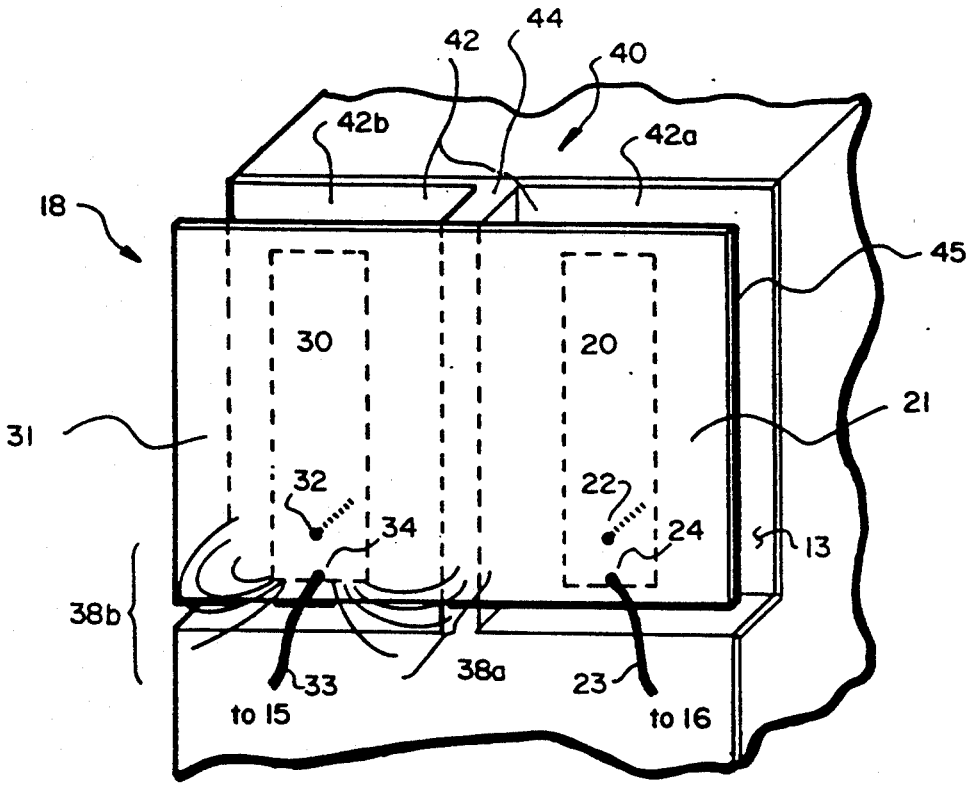
FIG. 2 is an isometric view of a planar antenna in accordance with this invention.

Antenna 18 is shown in more detail in FIG. 2. In this most basic embodiment, antenna 18 includes a pair of radiating elements, or patches 20, and 30 positioned above and facing a reference ground plane 40. More particularly, the antenna 18 consists of a printed circuit board 45 on which two radiating structures are formed, a receive patch 20 and a transmit patch 30. The circuit board 45 is preferably formed of a low-loss dielectric such as Duroid or other such material, and is plated on at least one side. (Duroid is a registered trademark of E. I. DuPont de Nemours and Company for dielectric circuit board materials.) The circuit board 45 is formed or mounted so as to be integral to the enclosure 13.

A feedpoint 24 provides direct connection from the transmitter 15 to the transmit patch 30, while feedpoint 34 provides direct connection from the receiver patch 20 to the receiver 16.

The ground plane 40 for the radiating patches 20 and 30 comprises an electrically conductive surface 42 of the enclosure 13, together with a conductive pedestal 44 extending from the flat surface 42. Pedestal 44 and surface 42 can be integral to enclosure or separately fabricated. The surface 42 may be formed of metal or of a conductively coated plastic.

The pedestal 44 divides the conductive surface 42 into a right surface section 42*a* positioned adjacent the receive patch 20 and a left surface section 42*b* positioned adjacent the transmit patch 30.

The physical arrangement of the patches 20 and 30 and ground plane 40 provides inherent isolation between the receive patch 20 and transmit patch 30. Because of this inherent isolation, the invention enables the filtering constraints required in high frequency transceivers to be relaxed.

The reason for this inherent isolation can be better understood by first considering that a receive antenna 21 is formed by the receive patch 20 and portions of the ground plane 40. The receive patch 20 is electrically shorted to the ground plane 40 via a shorting stub 22 which transfers energy from a point on the surface of the receive patch 20 to the right section 42*a*. A line 23 connected from the receiver 16 to a feed point 24 couples electromagnetic energy from the receiver 16 to the receive patch 20. Receive antenna 21 is thus similar to what is commonly known as a planar inverted-F (PIFA) antenna, to the extent it includes a receive patch 20 and the right section 42*a* of a ground plane. However, it differs from a conventional PIFA antenna in that the ground plane 40 includes a pedestal 44 as well.

The arrangement of receive antenna 21 is thus essentially a resonant cavity, with the geometry of the components determining the resonant frequency. The position of the feedpoint 24, shorting stub 22, and the shape of receive patch 20 are accordingly chosen to achieve the correct terminal impedance at the frequency of interest. Of course, different impedances presented by the receiver 16 to antenna 21 will affect the resonant frequency and thus the exact desired length also. For example, depending upon the exact shape of the receive patch 20, its length is preferably approximately one quarter of the wavelength of the carrier frequency used by the receiver 16. All of these parameters are interrelated, so that determination of the exact dimensions to achieve optimum radiation at the frequency of interest usually requires several iterations.

Similarly, a transmit antenna 31 is formed by the transmit patch 30, pedestal 44, and left conductive surface 42*b*. Transmit patch 30 has a shorting stub 32 positioned to achieve operation at the frequency of the transmitter 15. The feedpoint 34 is where electrical connection is made to pass transmitter signals to the transmit antenna 31 from the transmitter.

Thus, isolation is achieved because the two patch elements, along with their associated components, form high Q resonant circuits tuned to different frequencies. In addition, note that the near field radiation pattern lines 38*a* emanating from the right side edge of the transmit patch 30. Because of the proximity of the pedestal 44 formed part of the ground plane 40, the near field lines 38*a* tend to terminate at the pedestal 44, and tend not to radiate into the receive patch 20. Likewise, on the left hand edge of the transmit patch 30, the near field radiation pattern lines 38*b* tend to terminate along the outer edge of the ground plane section 42*b*, and not continue to radiate into the user's head, which is on the other side of the enclosure 13 from the radiating elements 20 and 30.

The far field antenna pattern contains mixed polarization because the ground plane is not large compared with the radiating elements, the ground plane is three dimensional, the elements are relatively wide, and the enclosure 13 has a non-uniform shape.

Consider also that the assigned frequency channels for cellular telephone operation in North America are between 824 to 849 MHz for the transmitter, and approximately 45 MHz higher, or between 869 to 894 MHz for the receiver. Since a conventional whip antenna is shared by the transmitter and receiver, it must cover the entire range from 824 to 894 MHz, or 70 MHz. However, an antenna 18 constructed in accordance with the invention, allocates the transmit and receive antenna functions to two separate structures. Thus, each structure need only operate over a much smaller bandwidth, namely 25 MHz.

Figure 3:
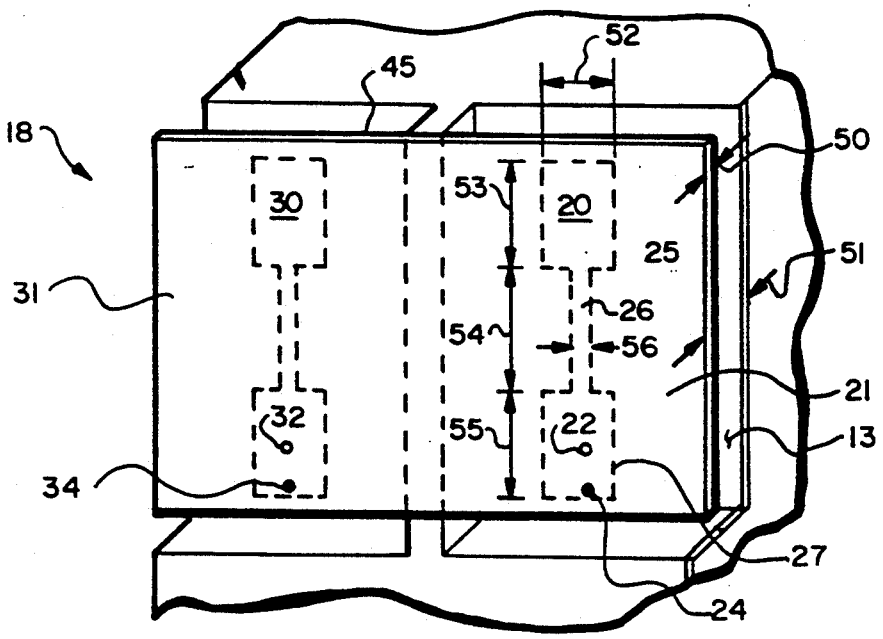
FIG. 3 is an isometric view of the antenna as configured for use at cellular telephone frequencies.

FIG. 3 shows one embodiment of antenna 18 adapted for use in the 800 to 900 megahertz (MHz) range, the band of interest for cellular operation. Consider receive patch 20, which includes a rectangular upper section 25 and rectangular lower section 27 joined by a narrower center section 26. Rectangular sections 25 and 27 are essentially capacitive, and the center section 26 is essentially inductive. With this arrangement, the inductance and capacitance at the resonant frequency of the receive patch 20 can be chosen essentially independently. As before, transmit patch 30 has approximately the same geometry as receive patch 20.

In this embodiment, the upper section 25 and lower section 27 have a horizontal dimension 52 of 1 centimeter (cm), and vertical dimensions 53 and 55, respectively, of 2 cm. The center section 26 is also about 2 cm in the vertical dimension 54, but about 4 millimeters (mm) wide in the horizontal dimension 56. The circuit board 45 has a thickness 50 of 1 mm, and is spaced a distance 51 of approximately 7 mm from the surface of the flat section 42.

The transmit patch 30 is similarly dimensioned, with its exact dimensions chosen to optimize operation at the carrier frequency of the transmitter.

In the embodiment of FIG. 3, each of the receive antenna 21 and transmit antenna 31 acts as a bandpass filter. In particular, a minimum 10 decibel (dB) isolation between the transmit and receive sections has been observed across the 800 to 900 MHz range. However, when this antenna 18 is used for cellular applications, the 10 dB inherent isolation may not satisfy design specifications. Thus, an auxiliary bandpass filter should normally be placed between the receive antenna 21 and the receiver 16, as well as in the path between the transmitter 15 and transmit antenna 31. However, the requirements of that auxiliary filter are greatly reduced when compared to that which is required when a more conventional antenna is used.

Figure 4:
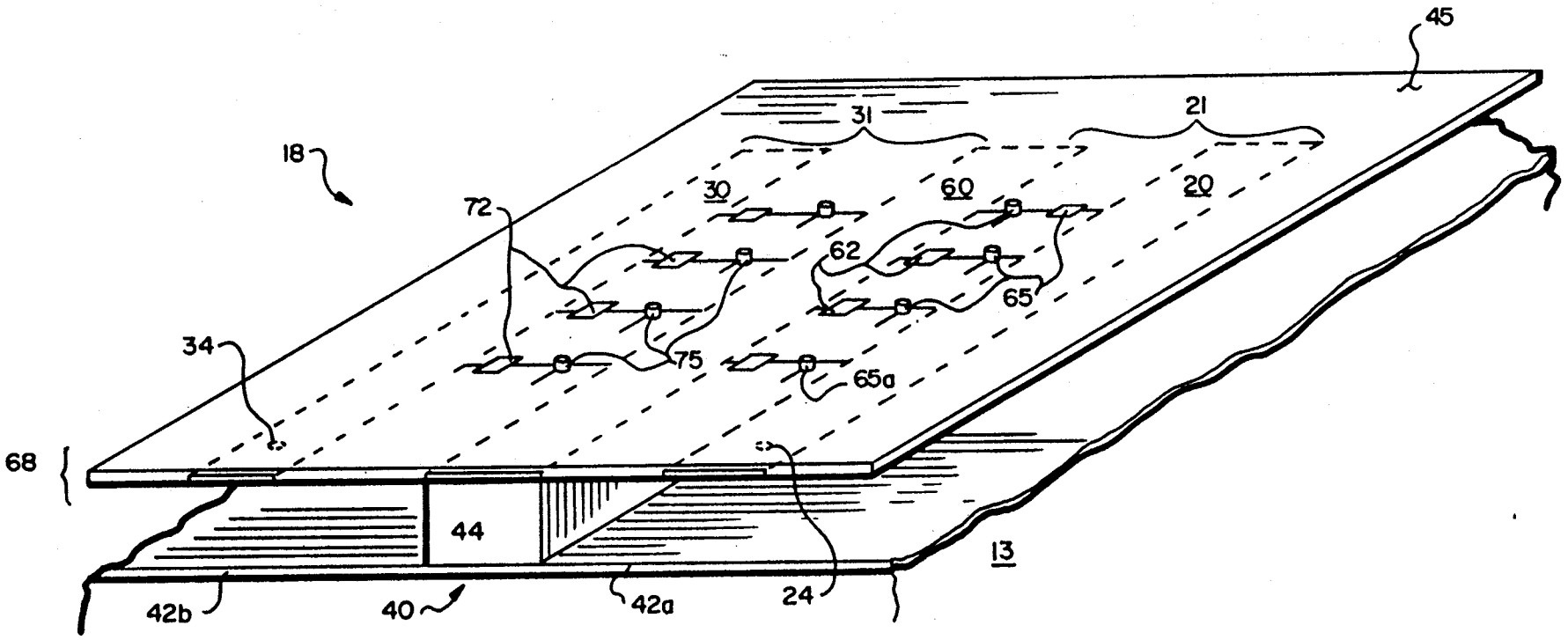
FIG. 4 is an isometric view of a tunable embodiment of the invention.

FIG. 4 shows another embodiment of the invention which is capable of being tuned over a bandwidth as large as the cellular operating band. As will be seen, this embodiment reduces auxiliary filtering requirements even further. As before, antenna 18 includes two radiators, that is, a receive patch 20 and transmit patch 30, positioned above a ground plane 40. Here, ground plane 40 includes a conductive surface 42 divided into two sections 42*a* and 42*b*, as well as a ground patch 60.

The circuit board 45 and conductive patches 20, 30, and 60 are preferably constructed using known microstrip circuit technology. This embodiment is thus referred to as a microstrip element antenna elevated over a ground plane, or, simply, an elevated microstrip antenna. Not only is the elevated microstrip embodiment tunable, but also it can be more easily manufactured than the antenna of FIG. 1.

Consider the receive antenna 21 more particularly. A feedpoint 24 is again provided. However, short stubs are not used—instead, the ground patch 60 is disposed between the receive patch 20 and transmit patch 30. Thus, the receive antenna 21 is formed by the receive patch 20, ground patch 60, right section 42*a*, and pedestal 44. Likewise, the transmit antenna 31 is formed by the transmit patch 30, and a ground plane 40 consisting of ground patch 60, left section 42*b*, and pedestal 44. An electrical connection between the ground patch 60 and the ground plane 40 at pedestal 44 is provided by insuring that the distance 68 between the lower surface of the ground patch 60 is sufficiently close to the upper surface of the pedestal 44 to thereby provide capacitive coupling between them.

Furthermore, a number of capacitors 62 are connected in series with a like number of switches 65 between the receive patch 20 and the ground patch 60.

The capacitors 62 and switches 65 enable the impedance of the receive patch 20 to be adjusted. Thus, capacitors 62 are switched in or out to provide a change in the impedance and hence the resonant frequency of the receive antenna 21. Switches 65 preferably comprise an appropriate RF switch element such as positive-intrinsic-negative (PIN) diodes.

Similarly, capacitors 72 and switches 75 are disposed in series between the ground patch 60 and transmit patch 30 to enable tuning of the transmit antenna 31.

To appreciate how tuning is accomplished, consider an exemplary switch 65*a* which receives an appropriate control signal from the circuits 17 (FIG. 1) to either connect or disconnect its associated capacitor 62*a*. Whether the control signal connects or disconnects the capacitor 62*a* depends upon the particular channel within the receiver band to which the receive antenna 21 is to be tuned.

By switching capacitor 62*a* in and out, the impedance of the receive patch 20 is altered. The greater the total capacitance which is switched in series between the receive patch 20 and ground patch 60, the lower the center frequency will be of receive antenna 21. Thus, if all of the capacitors 62 are switched in, the receive antenna 21 operates at its lowest possible frequency.

It should be noted that instead of switching shunted capacitors in or out, other means of adjusting the impedance of receive antenna 21 can be used. For example, the impedance of receive antenna 21 can also be adjusted by switching inductive components in or out of a series circuit arranged between the receive patch 20 and the ground patch 60.

Because the receive antenna 21 of FIG. 4 is tunable, the radiating elements 20 and 30 can now be much narrower in bandwidth. The desired bandwidth is covered by simply tuning each radiating element to the range in which operation is desired, by appropriate application of signals to the control inputs of the switches 65 and 75.

In the embodiment shown, the receive and transmit antennas 21 and 31 each use four switches. With four switches 65 as shown there are $2^4$ or sixteen possible frequencies to which each antenna 21 and 31 can be tuned. Thus, the transmit antenna 31 covers the transmit band of 824 to 849 MHz in 16 sub-bands of approximately 25 MHz/16 or 1.6 MHz, and the receive antenna 21 also covers the receive band of 869 to 894 MHz in 16 sub-bands of approximately 1-6 MHz.

Since each antenna need cover a much smaller bandwidth on the order of 2 MHz instead the 70 MHz required of a conventional antenna and, because the antennas are tunable, they inherently provide rejection of out-of-band signals. For example, because the receive antenna 21 acts as a 1.6 MHz bandwidth filter tuned to a particular sub-band within the receive band, there is greater inherent rejection of the corresponding transmitter frequency 45 MHz away. In addition, rejection of some in-band from adjacent channels is also inherent. That is, the receive antenna 21 inherently rejects signals which are within the receive band but which are outside the 1.6 MHz sub-band to which it is presently tuned.

Thus, a number of advantages result. First, antenna 18 is less expensive to manufacture then the whip antenna and duplexer which it replaces. In addition, the designer can, within reason, make the antenna as narrow- band as desired, and simply tune it up and down the band of interest. Of course, the narrower the bandwidth, the more capacitors and switches will be need to cover a given frequency range. The tuning capability also greatly improves the inherent rejection qualities of the structure. That is, while each capacitance 62 and 72 is chosen such that there is very little loss in the center of the receive band, the receive antenna 21 can be designed to have high loss at the corresponding transmit frequency, which will always be 45 MHz lower.

This in turn means that the RF filtering normally required to provide the necessary rejection of out-of-band signals can be relaxed. By eliminating poles in these filters, insertion loss is reduced, and thus the transmitter can make more efficient use of the available power. In addition, the RF filter itself can be physically smaller.

It has also been found advantageous to set the bandwidth of the transmit antenna 31 slightly wider than that of the transmit band divided by the number of possible switch settings. This is because a small amount of ripple will be evident in the passband response of the bandpass filter formed by the transmit antenna 31. It is believed that this ripple is primarily due to the fact that there are an integral number of capacitors which are switched in and out. However, any such ripple must be confined to less than 0.2 dB so that the transmit antenna 31 meets cellular telephone specifications. By slightly increasing the bandwidth of transmit antenna 31, the ripple requirements are more easily met.

It has been found that on the receive side more ripple can be tolerated. Thus, the bandwidth of the receive antenna 21 can be slightly less than that of the receive band divided by the number of possible switch settings.

Accordingly, a flatter response is usually preferred for the transmit antenna 31, because as much RF power as possible should exit the antenna, independent of operating frequency.

Figure 5:
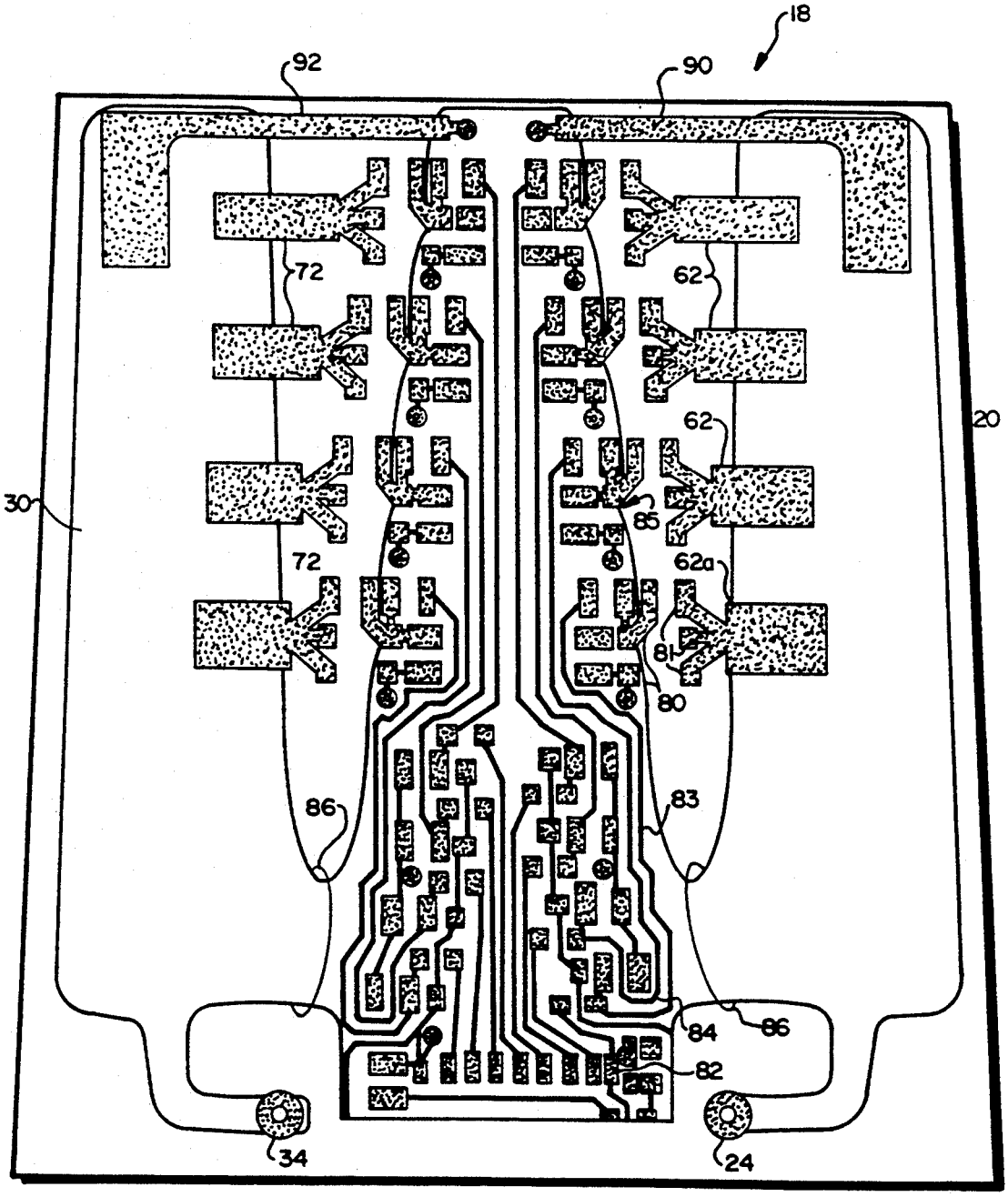
FIG. 5 is a detailed printed circuit board layout which can be used to construct the antenna of FIG. 4.

FIG. 5 shows a detailed layout for the antenna 18 in FIG. 4 on two-sided microstrip circuit board. The upper or outer layer metal is shaped to form the receive patch 20, ground patch 60, and transmit patch 30.

The lower layer metal, shown as stippled, is used primarily to define the capacitors 62 and 72 as well as the signal trace lines which form electrical connections between components. For example, an exemplary capacitor 62*a* is embodied as a rectangular section of metal. Since the corresponding PIN diode is a discrete component, the switch 65*a* is not explicitly visible in the printed circuit layout of FIG. 5. However, the mounting pads 80 and 81 to which it attaches are visible in portions of the lower layer metal adjacent the ground patch 60 and receive patch 20, respectively. A signal trace 83 provides a part of the connection between the PIN diode and the capacitor 62*a*. As will be seen shortly, the preferred embodiment uses additional discrete components in the switch 65*a*, and thus additional mounting pads 80 and 81 are need to secure them between the receive patch 20 and ground patch 60, as well as in another area 84 reserved for discrete components. An input signal pad 82 provides the control signal which determines the state of the switch 65*a*.

The radiating patches 20 and 30 were shown in FIG. 4 as physically separate from the ground patch 60. As is evident from FIG. 5, however, it may be desirable to provide a known high impedance between the radiating patches 20 and 30 and the ground patch 60 by including inductive sections 86.

A trimmer capacitor 90 may be formed so as to be placed permanently in series with the receive patch 20 and ground patch 60. Portions of the trimmer capacitor 90 can then be etched during the manufacturing process to further exactly tune the receive antenna 21. This compensates for inconsistencies in the manufacturing process. The trimmer capacitor is etched so that the receive antenna 21 is properly retuned to the highest-frequency sub-band when all capacitors 62 and 72 are switched out of the circuit. Similarly, a trimmer capacitor 92 can be disposed in series between the transmit patch 30 and ground patch 60.

The dimension of this layout are such that the distance 93 from top to bottom is approximately 5.9 cm. The printed circuit board on which this antenna 18 was fabricated was a dual-sided 0.75 mm thick duroid board.

Figure 6:
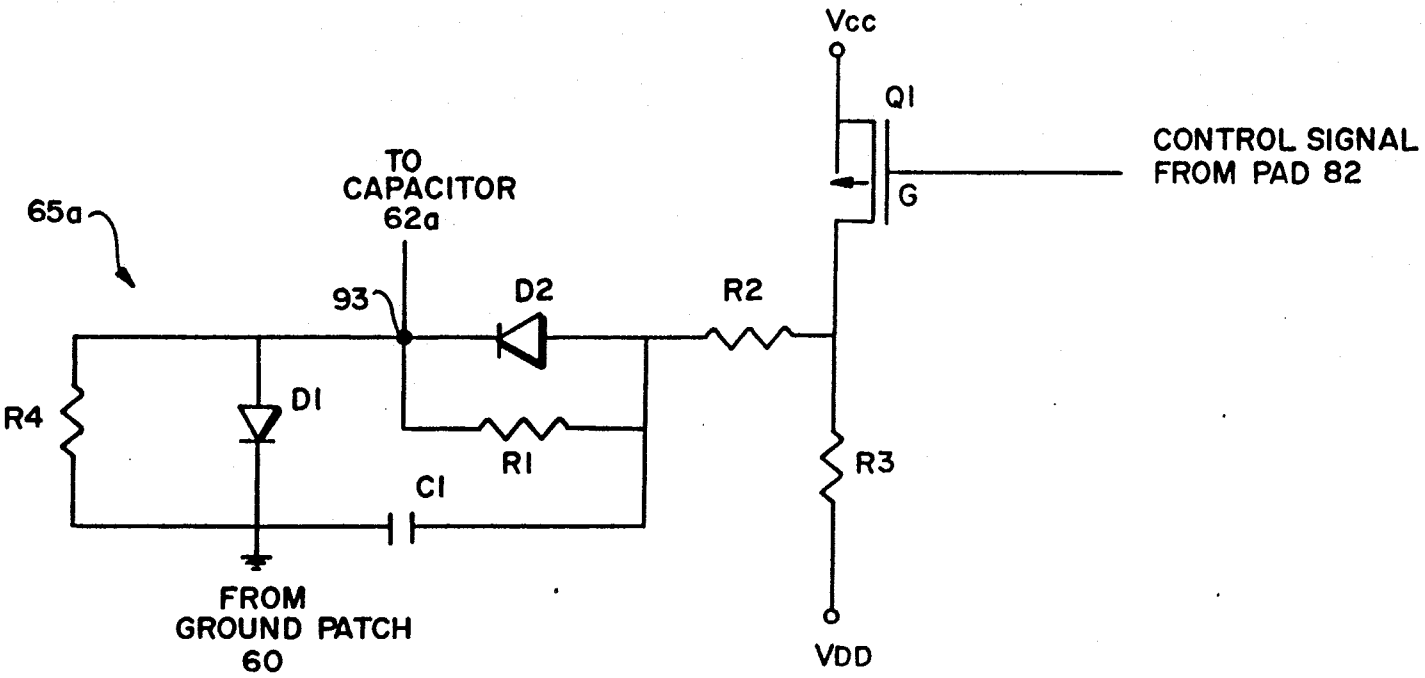
FIG. 6 is a detailed circuit diagram of one of the switch units in FIG. 4.

FIG. 6 is a detailed circuit diagram of the components of switch 65*a*. As seen, switch 65*a* includes positive-intrinsic-negative (PIN) diodes D1 and D2, field effect transistor (FET) Q1, capacitor C1, and resistors R1, R2, R3, and R4. PIN diode D1 is connected in series between the capacitor 62*a* and the ground patch 60, so that when PIN diode D1 is forward biased, current may flow from capacitor 62*a* (and hence the receive patch 20 to which capacitor 62*a* is attached) to ground patch 60. The gate of the FET Q1 receives the control signal from input signal pad 82. The source of FET Q1 is tied to a positive supply voltage, $V_{cc}$, the magnitude of which depends on the type of logic circuit which supplies the control signal. For example if the circuit is transistor-transistor logic (TTL) type, $V_{cc}$ will be 5 volts. The drain of FET Q1 is tied through resistor R3 to a negative voltage $V_{dd}$. A $V_{dd}$ of $-36$ volts was used in this embodiment, but the exact preferred voltage depends on the type of FET Q1 and PIN diode D1 used. The drain of FET Q1 is also tied through resistor R2 to the anode of PIN diode D2. The anode of PIN diode D2 is also tied to one terminal of resistor R1 and one terminal of capacitor C1. The other terminal of PIN diode D1 is connected to the cathode of PIN diode D2 and thus to the node 93 formed at the cathode of PIN diode D2. The anode of PIN diode D1 is also tied to this node 93; the voltage at node 93 thus determines whether the PIN diode D1 is in a low or high impedance state. The cathode of PIN diode D1 is connected to the ground patch 60. Finally, the resistor R4 is connected across the terminals of the PIN diode D1.

In operation, when the control input from input signal pad 82 is asserted to a high voltage, the FET Q1 is biased off. This in turn presents a negative voltage, through the resistors R3, R2 and R1, to the anode of D1, in turn also reverse-biasing the PIN diode D1 and thus shutting it off. Thus, current flow is prevented between receive patch 20 and ground patch 60.

When the control signal is asserted low, the FET Q1 is biased on. This in turn presents a positive voltage to PIN diode D2 and hence PIN diode D1 is biased on.

A simpler switch 65*a* would include only the PIN diode D1, FET Q1, resistors R2 and R3, and capacitor C1. However, it can be shown that the addition of PIN diode D2 and resistors R1 and R4 reduces attenuation due to the switch 65*a*.

Figure 7:
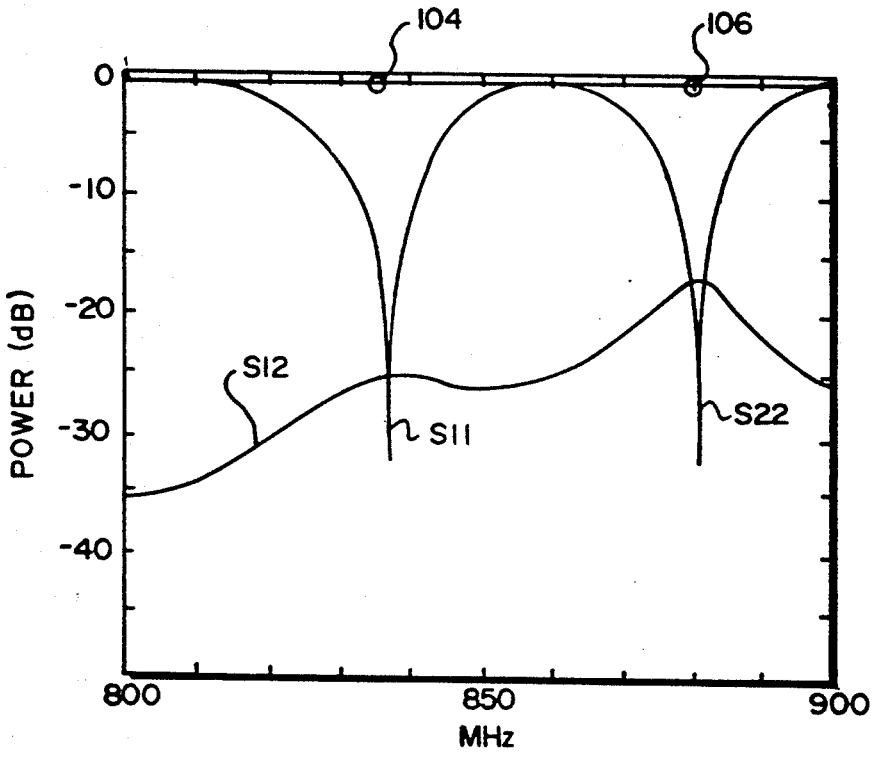
FIG. 7 shows s parameter diagrams which exhibit the extent of the duplexing action achievable with an antenna constructed in accordance with this invention.

FIG. 7 is an s-parameter measurement which shows the duplexing action obtainable with the antenna 18 of FIGS. 4 and 5. The measurement was taken by insuring that the antenna 18 sees a 50 ohm load. The transmitter feedpoint 34 was connected to port 1, and the receiver feedpoint 24 to port 2 of the s-parameter so that network s-parameter s11 measures the amount of power reflected back to the transmitter feedpoint 34, otherwise known as the transmit return loss. S-parameter s22 is thus the receiver return loss. S-parameter s12 is thus the power measured at the receiver port with power applied to the transmitter port. As seen at a point 106 within the receiver sub-band, any signals directly passing from the transmitter to the receiver are attenuated by approximately 20 dB. At a point 104 in the transmitter subband, receive signals are attenuated 26 dB.

It can now be understood how an antenna 18 constructed in accordance with the invention achieves the various advantages mentioned previously. Because the transmit and receive patches are inherent resonant or band-pass structures, significant isolation between the transmitter and receiver is provided. Because of this inherent isolation, the filtering requirements normally associated with duplex radio operation are reduced. Insertion loss is minimized, since rejection of at least some out-of-band frequencies is due to the physical structure of the antenna.

In addition, because the antenna can be fabricated to be tunable, it significantly reduces the requirements of front-end filters and duplexers normally required in high frequency radio transceivers.

The antenna can occupy less space than a conventional antenna and duplexer.

The near-field of the antenna is such that direct radiation into the user's head is minimized.

A significant cost savings can be realized over conventional arrangements that use an antenna and separate duplexer.

The foregoing description has been limited to a specific embodiment of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed is:

1. An antenna comprising:

A. a receive radiating element having a receiver feedpoint, the receive radiating element formed as a first planar patch;

B. a transmit radiating element having a transmitter feedpoint, the transmit radiating element formed as a second layer patch, the second path being disposed in the same plane as the first patch;

C. a ground reference element, disposed between the first and second patches, for isolating the receive element from the transmit element so that the antenna simultaneously receives at a first frequency while transmitting at a second frequency; and D. means for tuning each of the transmit and receive radiating elements, comprising:

i. a plurality of receive impedances;

ii. a plurality of receive switches, the number of receive switches corresponding to the number of receive impedances, each receive switch coupled to the receive radiating element, the ground element, and a corresponding one of the receive impedances, and each receive switch arranged to control whether its respective receive impedance is electrically coupled between the ground element and the receive element;

iii. a plurality of transmit impedances; and iv. a plurality of transmit switches, the number of transmit switches corresponding to the number of transmit impedances, each transmit switch coupled to the transmit element, the ground element, and a corresponding one of the transmit impedances, and each transmit switch arranged to control whether its respective transmit impedance is electrically coupled between the ground element and the transmit element.

2. An antenna as in claim 1 wherein each of the impedances are capacitors, and each of the switches comprises a positive-intrinsic-negative diode connected between the ground element and the corresponding capacitor associated with the switch.

3. An antenna as in claim 2 wherein each of the switches additionally comprises a field-effect transistor coupled to the diode to control whether the diode is in a forward-biased conductive state or a reverse-biased non-conductive state.

4. An antenna as in claim 3 wherein each of the switches additionally comprises means for reverse-biasing the diode when the field-effect transistor is biased to a non-conductive state.

5. A radio transceiver comprising:

A. An enclosure in which are disposed a receiver and a transmitter; and

B. an antenna comprising:

i. a receive radiating element formed as a first planar patch;

ii. a transmit radiating element formed as a second planar patch, the transmit radiating element disposed in the same plane as the receive radiating element;

iii. a ground plane disposed in a second plane which is parallel to the plane containing the receive and transmit elements;

iv. means for selectively connecting the transmit and receive radiating elements to selected points in the ground plane; and v. means for isolating the transmit and receive elements from each other.

6. An apparatus in claim 5 wherein the enclosure contains conductive surfaces and the ground plane is connected to the conductive surfaces of the enclosure.

7. A radio transceiver comprising:

A. an enclosure having a planar conductive surface positioned therein;

B. a microstrip printed circuit board having formed thereon a transmit radiating element, a receive radiating element, and a ground reference element, the three elements formed as patches of conducting material on an upper surface of the board, the ground reference element disposed between the transmit and receive elements; and C. a pedestal, having conductive outer surfaces, disposed between the planar conductive surface of the enclosure and the circuit board, and arranged to support the circuit board above the planar conductive surface of the enclosure, the upper conductive surface of the pedestal positioned sufficiently close to the ground reference element to be electrically connected to the ground reference element, and the lower conductive surface of the pedestal positioned sufficiently close to the conductive surface of the enclosure to be electrically connected to the conductive surface of the enclosure.

8. Apparatus as in claim 7 additionally comprising:

D. a first plurality of switch means, disposed between the receive radiating patch and the ground reference patch; and E. a second plurality of switch means, disposed between the transmit radiating patch and the ground reference patch.

9. An antenna comprising:

A. a planar conductive surface;

B. a microstrip printed circuit board having formed thereon a transmit radiating element, a receive radiating element, and a ground reference element, the three elements formed as patches of conducting material on an upper surface of the board, the ground reference element disposed between the transmit and receive elements; and C. a pedestal, having conductive outer surfaces, disposed between the planar conductive surface and the circuit board, and arranged to support the circuit board above the planar conductive surface, the upper conductive surface of the pedestal positioned sufficiently close to the ground reference element to be electrically connected to the ground reference element, and the lower conductive surface of the pedestal positioned sufficiently close to the planar conductive surface to be electrically connected to the planar conductive surface.

10. Apparatus as in claim 9 additionally comprising:

a plurality of switch means, disposed between the receive radiating patch and the ground reference patch.

11. Apparatus as in claim 9 additionally comprising:

a plurality of switch means, disposed between the transmit radiating patch and the ground reference patch.

12. An antenna as in claim 9 additionally comprising means for tuning the receive radiating element.

13. An antenna as in claim 9 additionally comprising means for tuning the transmit radiating element.

14. An antenna for use with a hand-held cellular telephone which is held to the head of a user when in use, the antenna comprising:

A. a receive radiating element having a receiver feedpoint, the receive radiating element formed as a first rectangular patch having a major axis;

B. a transmit radiating element having a transmitter feedpoint, the transmit radiating element formed as a second rectangular patch having a major axis, the transmit radiating element disposed in the same plane as the receive radiating element, and such that the major axis of the transmit radiating element is parallel to the major axis of the receive radiating element;

C. a ground reference plane, disposed adjacent the receive and transmit radiating elements and positioned such that the ground reference plane is between said radiating elements and the head of a user when the telephone is in use; and D. a ground reference element electrically connected to the ground reference plane, the ground reference element formed as a third rectangular patch having a major axis, the ground reference element disposed between the receive and transmit elements and int he same plane as the receive and transmit radiating elements with the major axis of the ground reference element parallel to the major axes of the transmit radiating element and the receive radiating element, the ground reference element further positioned to isolate the receive radiating element from the transmit radiating element;

the ground reference element and the ground reference plane positioned relative to the radiating elements so as to terminate near field radiation such that the radiation does no tend to (i) continue into the head of a user or (ii) continue from one radiating element to the other radiating element, and E. means for tuning the transmit radiating element, comprising:

i. a plurality of impedances; and ii. a plurality of switches, the number of switches corresponding to the number of impedances, each switch coupled to the transmit radiating element, the ground reference element, and a corresponding one of the impedances, and each switch arranged to control whether its respective impedance is electrically coupled between the ground element and the transmit element.

15. An antenna as in claim 40 further comprising:

E. means for tuning the receive radiating element, comprising:

i. a plurality of impedances; and ii. a plurality of switches, the number of switches corresponding to the number of impedances, each switch coupled to the receive radiating element, the ground reference element, and a corresponding one of the impedances, and each switch arranged to control whether its respective impedance is electrically coupled between the ground element and the receive element.

16. An antenna as in claim 15 wherein each of the impedances are capacitors, and wherein each of the switches comprises a positive-intrinsic-negative diode connected between the ground element and the corresponding capacitor associated with the switch.

17. An antenna as in claim 16 wherein each of the switches additionally comprises a field-effect transistor coupled to the diode to control whether the diode is n a forward-biased conductive state or a reverse-biased non-conductive state.

18. An antenna as in claim 17 wherein each of the switches additionally comprises means for reverse-biasing the diode when the field-effect transistor is biased to a non-conductive state.

19. An antenna for use with a hand-held cellular telephone which is held to the head of a user when in use the antenna comprising:

A. a receive radiating element having a receiver feedpoint, the receive radiating element formed as a first rectangular patch having a major axis;

B. a transmit radiating element having a transmitter feedpoint, the transmit radiating element formed as a second rectangular patch having a major axis, the transmit radiating element disposed in the same plane as the receive radiating element, and such that the major axis of the transmit radiating element is parallel to the major axis of the receive radiating element;

C. a ground reference plane, disposed adjacent the receive and transmit radiating elements and positioned such that the ground reference plane is between said radiating element sand the head of a user when the telephone is in use; and D. a ground reference element electrically connected to the ground reference plane, the ground reference element formed a s a third rectangular patch having a major axis, the ground reference element disposed between the receive and transmit elements and in the same plane as the receive and transmit radiating elements with the major axis of the ground reference element parallel to the major axes of the transmit radiating element and the receive radiating element, the ground reference element further positioned to isolate the receive radiating element from the transit radiating element;

the ground reference element and the ground reference plane positioned relative to the radiating elements so as to terminate near field radiation such that the radiation does into tend to (i) continue into the head of a user or (ii) continue from one radiating element to the other radiating element, and E. a pedestal having conductive outer surfaces, the pedestal disposed between the ground reference plane and the ground reference element, with the pedestal mounted on the ground reference plane, and the pedestal spaced apart from but sufficiently close to the ground reference element so that the ground reference element and ground reference plane are electrically connected by capacitive coupling.

20. An antenna comprising:

A. a microstrip printed circuit board, having formed on one surface thereof:

i. a receive radiating element formed as a first rectangular patch having a major axis;

ii. a transmit radiating element formed a second rectangular patch having a major axis, the transmit radiating element disposed such that the major axis is parallel to the major axis of the receive radiating element; and iii. a ground reference element formed as a third rectangular patch having a major axis, the ground reference element disposed between the receive and transmit elements, such that the major axis of the ground reference element is parallel to the major axes of the receive and transmit radiating elements, the ground reference element being positioned to terminate near field radiation from the transmit and receive elements;

B. a ground plane, disposed adjacent the microstrip printed circuit board, the ground reference element being electrically connected to the ground plane; and C. a pedestal having a major axis and conductive outer surfaces, the pedestals disposed between the ground plane and the microstrip printed circuit board, with the major axis of the pedestal parallel to the major axis of the ground reference element, and the pedestal spaced sufficiently close to the ground reference element so that the ground reference element and ground reference plane are electrically connected by capacitive coupling.

* * * * *